US007711558B2

(12) United States Patent
Jang et al.

(10) Patent No.: US 7,711,558 B2
(45) Date of Patent: May 4, 2010

(54) APPARATUS AND METHOD FOR DETECTING VOICE ACTIVITY PERIOD

(75) Inventors: Gil-jin Jang, Suwon-si (KR); Jeong-su Kim, Yongin-si (KR); Kwang-cheol Oh, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 927 days.

(21) Appl. No.: 11/472,304

(22) Filed: Jun. 22, 2006

(65) Prior Publication Data

US 2007/0073537 A1 Mar. 29, 2007

(30) Foreign Application Priority Data

Sep. 26, 2005 (KR) ..... 10-2005-0089526

(51) Int. Cl.
*G10L 21/02* (2006.01)

(52) U.S. Cl. ..... 704/233; 704/226; 704/231; 370/290

(58) Field of Classification Search ..... 704/226, 704/231, 233; 370/290
See application file for complete search history.

(56) References Cited

U.S. PATENT DOCUMENTS

| | | | | |
|---|---|---|---|---|
| 4,897,878 | A | 1/1990 | Boll et al. | |
| 5,148,489 | A * | 9/1992 | Erell et al. | 704/226 |
| 6,044,341 | A * | 3/2000 | Takahashi | 704/226 |
| 6,615,170 | B1 * | 9/2003 | Liu et al. | 704/233 |
| 7,047,047 | B2 * | 5/2006 | Acero et al. | 455/563 |
| 2002/0116187 | A1 * | 8/2002 | Erten | 704/233 |
| 2002/0173276 | A1 | 11/2002 | Tschirk | |
| 2002/0184014 | A1 * | 12/2002 | Parra et al. | 704/231 |

FOREIGN PATENT DOCUMENTS

| | | |
|---|---|---|
| JP | 04-251299 | 9/1992 |
| JP | 07-306695 | 11/1995 |
| JP | 10-240294 | 9/1998 |
| JP | 2005-202932 | 7/2005 |
| KR | 10-2004-0056977 | 7/2004 |
| WO | WO 01-39175 A1 | 5/2001 |

OTHER PUBLICATIONS

"Extended advanced front-end feature extraction algorithm," European Telecommunications Standard Institute (ETSI), Nov. 2003.

* cited by examiner

*Primary Examiner*—Daniel D Abebe
(74) *Attorney, Agent, or Firm*—Staas & Halsey LLP

(57) ABSTRACT

An apparatus and method for detecting a voice activity period. The apparatus for detecting a voice activity period includes a domain conversion module that converts an input signal into a frequency domain signal in the unit of a frame obtained by dividing the input signal at predetermined intervals, a subtracted-spectrum-generation module that generates a spectral subtraction signal which is obtained by subtracting a predetermined noise spectrum from the converted frequency domain signal, a modeling module that applies the spectral subtraction signal to a predetermined probability distribution model, and a speech-detection module that determines whether a speech signal is present in a current frame through a probability distribution calculated by the modeling module.

16 Claims, 7 Drawing Sheets

APPARATUS AND METHOD FOR DETECTING VOICE ACTIVITY PERIOD

CROSS-REFERENCE TO RELATED APPLICATION

This application is based on and claims priority from Korean Patent Application No. 10-2005-0089526, filed on Sep. 26, 2005, the disclosure of which is incorporated herein by reference.

BACKGROUND OF THE INVENTION

1. Field of the Invention

The present invention relates to voice activity detection, and more particularly to an apparatus and method for detecting a speech signal period from an input signal by using spectral subtraction and a probability distribution model.

2. Description of Related Art

With the development of technology, various devices have been developed that can more conveniently maintain peoples' lifestyles. In particular, devices have been provided that can recognize speech and properly react to it. This capability is known as speech recognition.

The principal technologies of such speech recognition include a technology that detects a period where a speech signal is present in an input signal, and a technology that captures the content included in the detected speech signal.

Voice detection technology is required in speech recognition and speech compression. The core of this technology is to distinguish the speech and noise of an input signal.

A representative example of this technology includes the "Extended Advanced Front-end Feature Extraction Algorithm" (hereinafter, referred to as "first conventional art") which was selected by the European Telecommunication Standard Institute (ETSI) in November of 2003. According to this algorithm, a voice activity period is detected based on energy information in a speech frequency band by using a temporal change of a feature parameter with respect to a speech signal in which a noise is removed. However, when the noise level is high, performance may be deteriorated.

Also, Korean Patent No. 10-304666 (hereinafter, referred to as "second conventional art") discloses a method for detecting a voice activity period by estimating in real-time each component of a noise signal and a speech signal from a speech signal having noise using statistical modeling such as the complex Gaussian distribution. However, even in this case, when the magnitude of a noise signal becomes greater than the magnitude of a speech signal, a voice activity period may not be detected.

According to the above-described conventional art, a signal-to-noise ratio (hereinafter, referred to as "SNR") decreases, that is, the magnitude of noise increases, and thus it may not be easy to distinguish a speech period from a noise period, as shown in FIGS. 1A to 1D.

FIGS. 1A to 1D are histograms illustrating a distribution of a speech signal 110 having noise and a noise signal 120 according to a change in an SNR. Referring to FIGS. 1A to 1D, an x-X-axis represents the magnitude of band energy in a frequency band between 1 kHz and 1.03 kHz, and a y-axis represents a probability with respect thereto.

Also, FIG. 1A illustrates a histogram when an SNR is 20 dB, FIG. 1B illustrates a histogram when an SNR is 10 dB, FIG. 1C illustrates a histogram when an SNR is 5 dB, and FIG. 1D illustrates a histogram when an SNR is 0 dB.

Referring to FIGS. 1A to 1D, as the SNR value decreases, the speech signal 110 having noise is more concealed by the noise signal 120. Accordingly, the speech signal 110 having noise may not be distinguished from the noise signal 120.

Specifically, according to the conventional methods, a speech period and a noise period may not be easily distinguished from each other in an input signal having a low SNR value.

BRIEF SUMMARY

An aspect of the present invention provides an apparatus and method for detecting a voice activity period that can reduce an error of distribution estimation by estimating the distribution of a speech period and a noise period even in a low SNR region and by using a statistical modeling method with respect to an estimated speech spectrum.

According to an aspect of the present invention, there is provided an apparatus for detecting a voice activity period, which includes a domain conversion module converting an input signal into a frequency domain signal in the unit of a frame obtained by dividing the input signal at predetermined intervals, a subtracted-spectrum-generation module generating a spectral subtraction signal which is obtained by subtracting a predetermined noise spectrum from the converted frequency domain signal, a modeling module applying the spectral subtraction signal to a predetermined probability distribution model, and a speech-detection module determining whether a speech signal is present in a current frame through a probability distribution calculated by the modeling module.

According to another aspect of the present invention, there is provided a method of detecting a voice activity period, which includes converting an input signal into a frequency domain signal in the unit of a frame obtained by dividing the input signal at predetermined intervals, generating a spectral subtraction signal which is obtained by subtracting a predetermined noise spectrum from the converted frequency domain signal, applying the spectral subtraction signal to a predetermined probability distribution model, and determining whether a speech signal is present in a current frame through a probability distribution according to an application of the probability distribution model.

According to another aspect of the present invention, there is provided a computer-readable storage medium encoded with processing instructions for causing a processor to execute the aforementioned method.

Additional and/or other aspects and advantages of the present invention will be set forth in part in the description which follows and, in part, will be obvious from the description, or may be learned by practice of the invention.

BRIEF DESCRIPTION OF THE DRAWINGS

The above and/or other aspects and advantages of the present invention will become apparent and more readily appreciated from the following detailed description, taken in conjunction with the accompanying drawings of which.

DETAILED DESCRIPTION OF EMBODIMENTS

Figure 1A:
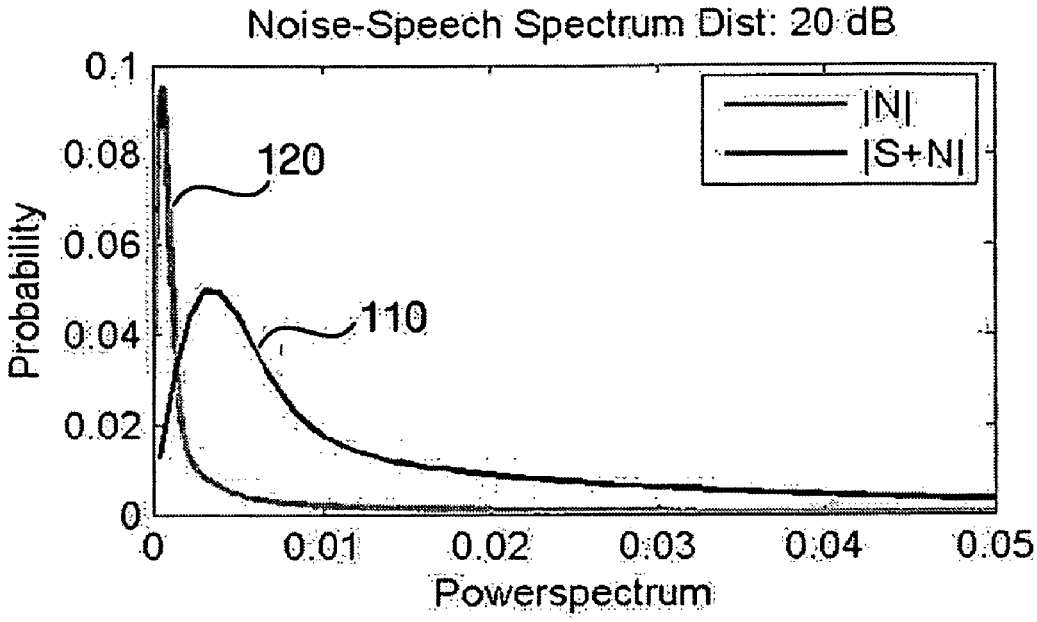
FIG. 1A (Related Art)
FIGS. 1A to 1D are histograms illustrating the distribution of a speech signal having noise and a noise signal according to a change in an SNR.
Figure 1B:
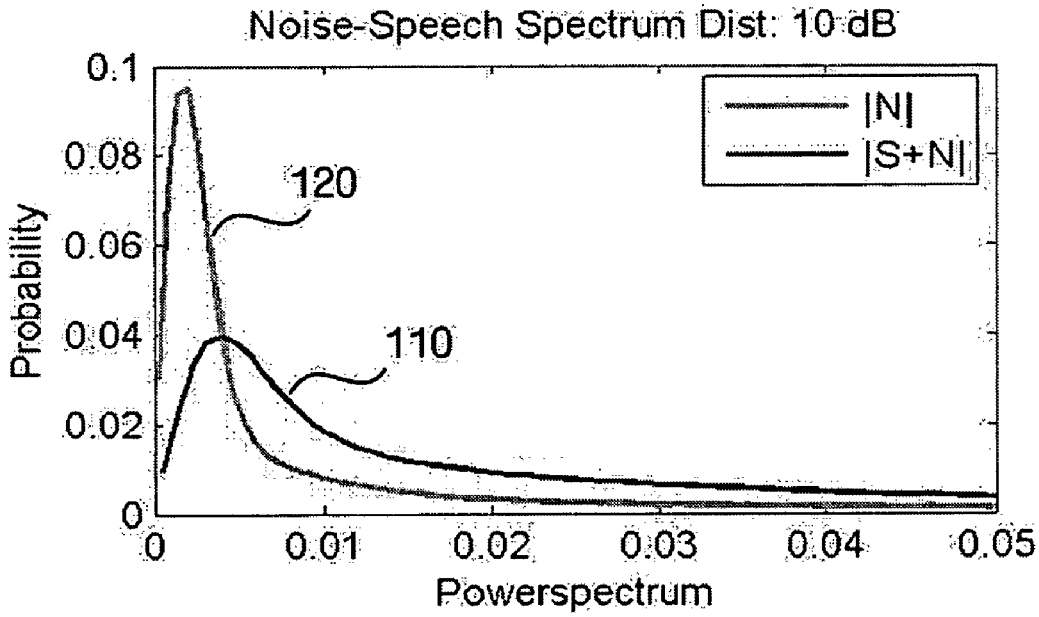
FIG. 1B (Related Art)
Figure 1C:
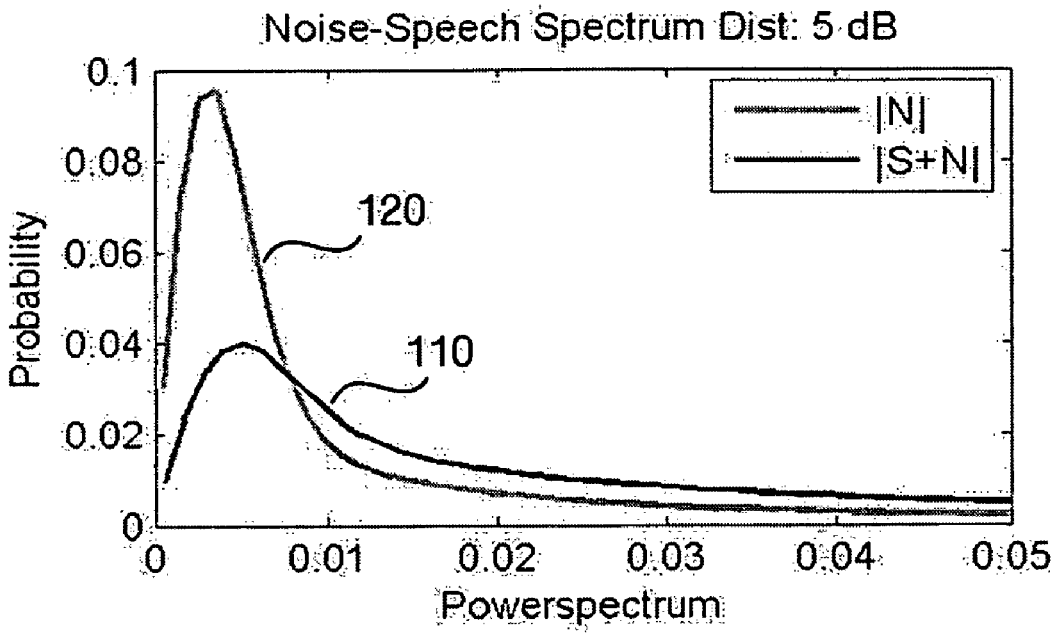
FIG. 1C (Related Art)
Figure 1D:
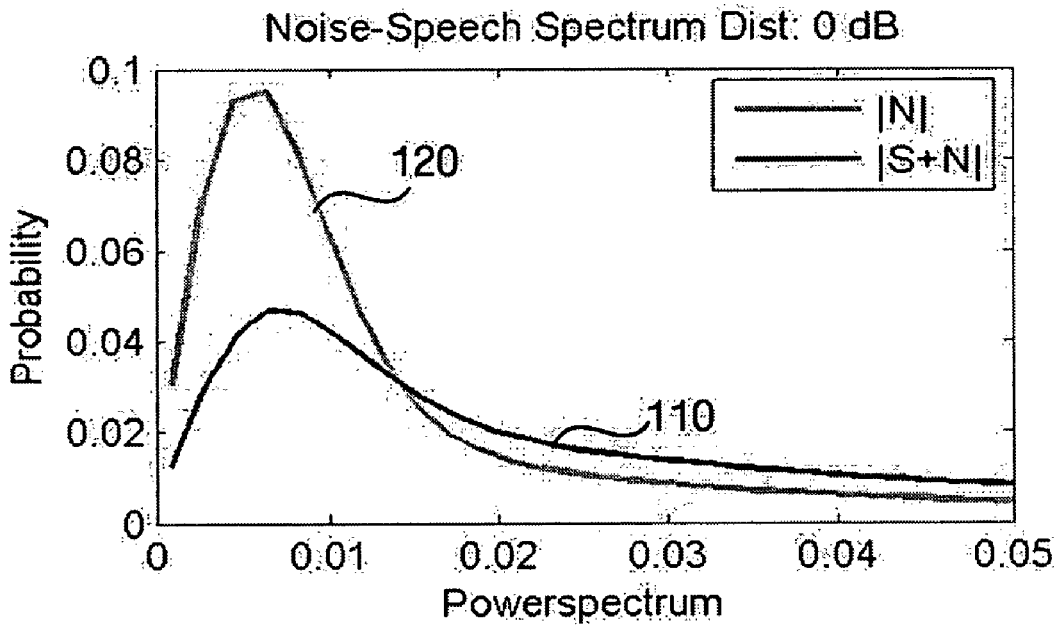
FIG. 1D (Related Art)

Reference will now be made in detail to embodiments of the present invention, examples of which are illustrated in the accompanying drawings, wherein like reference numerals refer to the like elements throughout. The embodiments are described below in order to explain the present invention by referring to the figures.

Embodiments of the present invention are described hereinafter with reference to flowchart illustrations of user interfaces, methods, and computer program products according to embodiments of the invention. It should be understood that each block of the flowchart illustrations, and combinations of blocks in the flowchart illustrations, can be implemented by computer program instructions. These computer program instructions can be provided to a processor of a general purpose computer, special purpose computer, or other programmable data processing apparatus to produce a machine, such that the instructions, which execute via the processor of the computer or other programmable data processing apparatus, create means for implementing the functions specified in the flowchart block or blocks.

These computer program instructions may also be stored in a computer-usable or computer-readable memory that can direct a computer or other programmable data processing apparatus to function in a particular manner, such that the instructions stored in the computer-usable or computer-readable memory produce an article of manufacture including instruction means that implement the function specified in the flowchart block or blocks.

The computer program instructions may also be loaded into a computer or other programmable data processing apparatus to cause a series of operations to be performed in the computer or other programmable apparatus to produce a computer implemented process such that the instructions that execute in the computer or other programmable apparatus provide operations for implementing the functions specified in the flowchart block or blocks.

Also, each block of the flowchart illustrations may represent a module, segment, or portion of code, which includes one or more executable instructions for implementing the specified logical function(s). It should also be noted that in some alternative implementations, the functions noted in the blocks may occur in an order that differs from that illustrated and/or described. For example, two blocks shown in succession may be executed substantially concurrently or the blocks may sometimes be executed in reverse order depending upon the functionality involved.

In the following embodiment of the present invention, the term "module", as used herein, means, but is not limited to, a software or hardware component, such as a Field Programmable Gate Array (FPGA) or an Application Specific Integrated Circuit (ASIC), which performs certain tasks. A module may advantageously be configured to reside on the addressable storage medium and configured to execute on one or more processors. Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and modules may be combined into fewer components and modules or further separated into additional components and modules. In addition, the components and modules may be implemented so as to execute one or more CPUs in a device.

Figure 2:
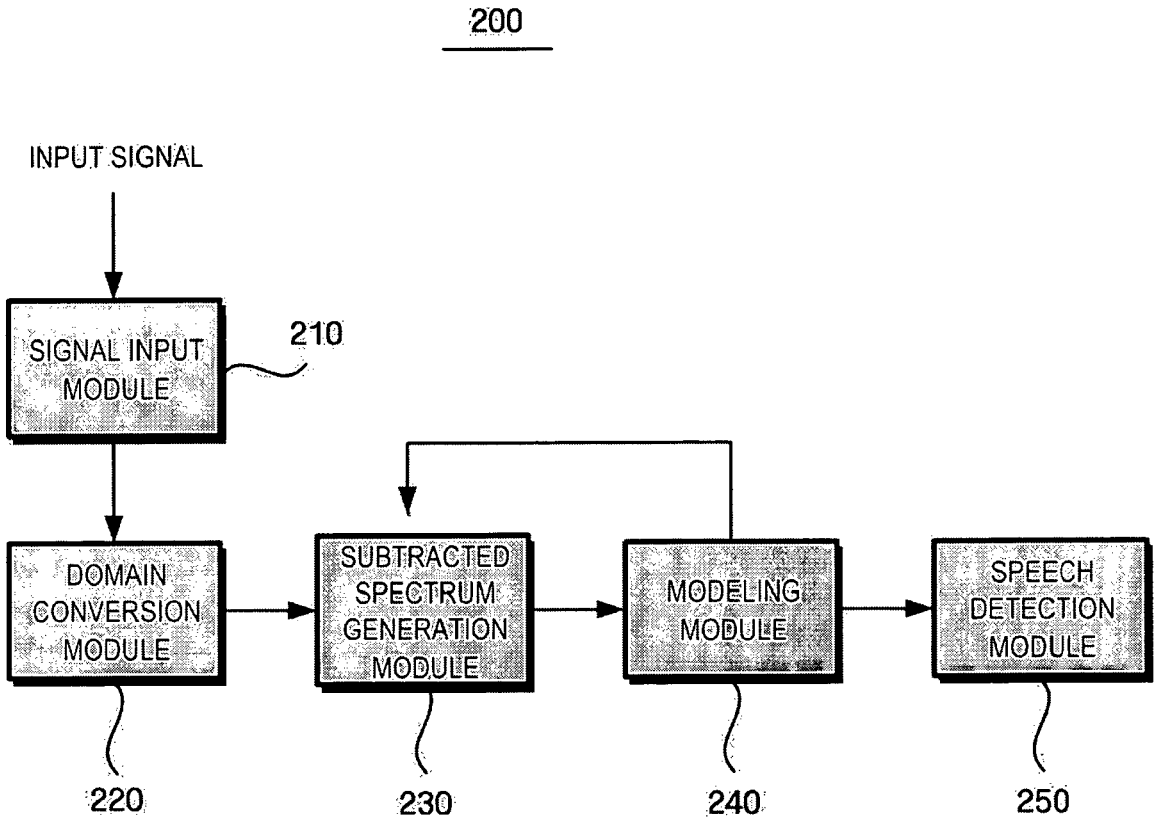
FIG. 2 is a block diagram illustrating the construction of an apparatus for detecting a voice activity period according to an embodiment of the present invention.

FIG. 2 is a block diagram illustrating the construction of an apparatus for detecting a voice activity period according to an embodiment of the present invention.

Referring to FIG. 2, an apparatus 200 for detecting a voice activity period according to the embodiment of the present invention includes a signal input module 210, a domain conversion module 220, a subtracted-spectrum-generation module 230, a modeling module 240 and a speech-detection module 250.

The signal input module 210 receives an input signal using a device such as, by way of a non-limiting example, a microphone. The domain conversion module 220 converts an input signal into a frequency domain signal. Specifically, the domain conversion module 220 converts a time domain input signal into a frequency domain signal.

Advantageously, the domain conversion module 220 may perform a domain conversion operation of the input signal in the unit of a frame which is obtained by dividing the input signal at predetermined time intervals. In this case, one frame corresponds to one signal period, and the domain conversion operation of the (n+1)-th frame is performed after a speech detection operation of the n-th frame is completed.

The subtracted-spectrum-generation module 230 generates a signal (hereinafter, referred to as "spectral subtraction signal") obtained by subtracting a predetermined noise spectrum of a previous frame from an input frequency spectrum of an input signal.

The noise spectrum may be calculated by using speech absence probability information received from the modeling module 240.

The modeling module 240 sets a predetermined probability distribution model and applies a spectral subtraction signal received from the subtracted-spectrum-generation module 230 to the set probability distribution model. In this case, the speech-detection module 250 determines whether a speech signal is present in a current frame based on the calculated probability distribution by the modeling module 240.

Figure 3:
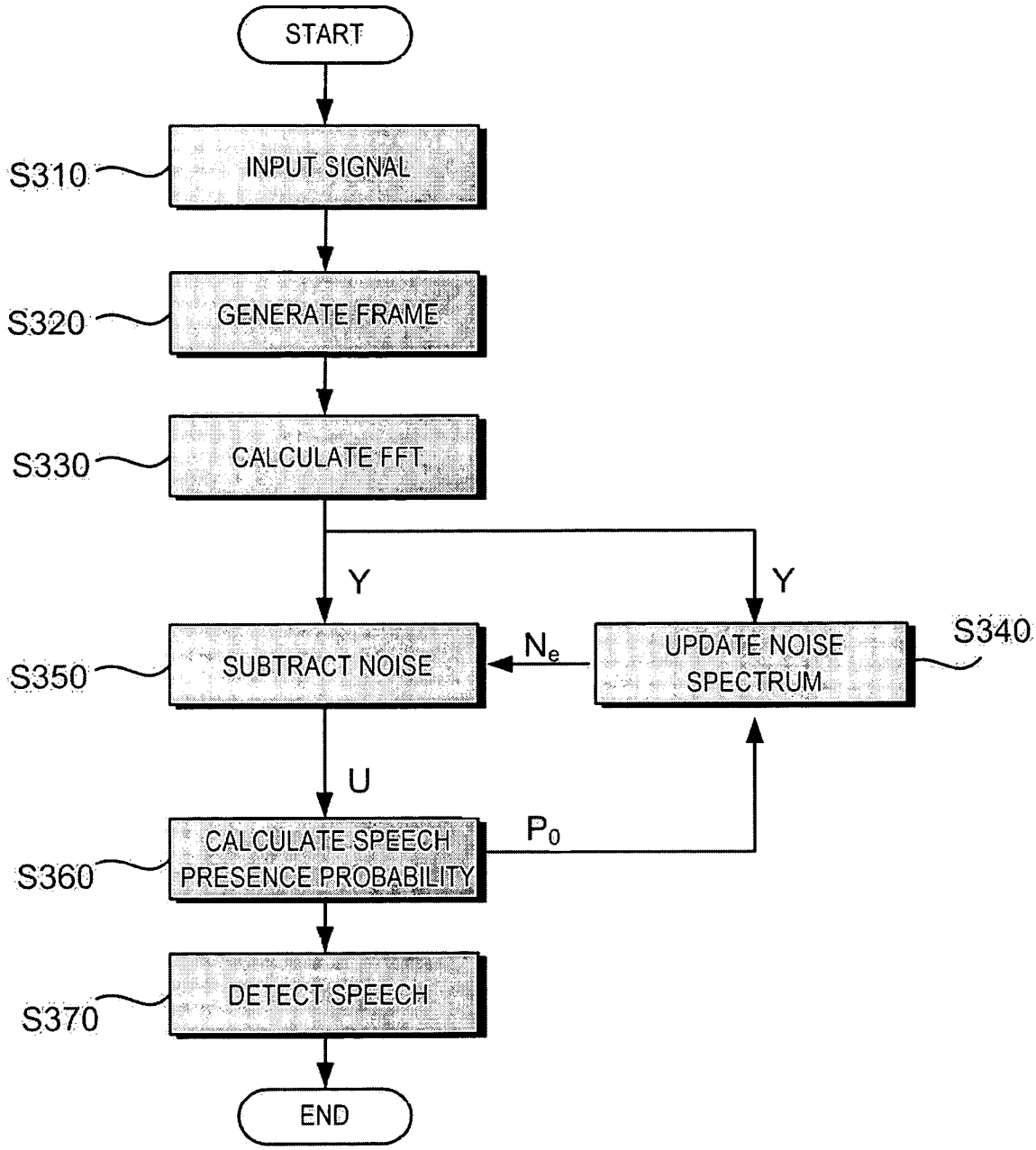
FIG. 3 is a flowchart illustrating a method of detecting a voice activity period according to an embodiment of the present invention.

FIG. 3 is a flowchart illustrating a method of detecting a voice activity period according to an embodiment of the present invention. For ease of explanation only, this method is described with reference to the apparatus of FIG. 2. However, it is to be understood that the method may be executed by apparatuses of both similar and dissimilar configurations to that of FIG. 2.

A signal is input via the signal input module 210 S310. A frame of the input signal is generated by the domain conversion module 220 S320. In this case, the frame of the input signal may be transmitted to the domain conversion module 220 after being generated by the signal input module 210.

The generated frame undergoes a Fast Fourier Transform (FFT) by means of the domain conversion module 220, and is expressed as a frequency domain signal S330. Specifically, a time domain input signal is converted into a frequency domain input signal.

If it is assumed that an absolute value of a frequency spectrum generated by the FFT is Y, the subtracted-spectrum-generation module 230 subtracts a noise spectrum $N_e$ from Y S350, wherein U represents the subtracted result.

The noise spectrum $N_e$ represents an estimate of a noise spectrum with respect to a previous frame. Accordingly, supposing that a frame index is t, U can be expressed as:

$$U(t)=Y(t)-N_e(t-1) \quad (1)$$

In this case, $N_e(t)$ may be modeled by:

$$N_e(t)=\eta P_0 Y(t)+(1\eta P_0)N_e(t-1) \quad (2)$$

In Equation 2, η represents a noise updating rate and has a value between 0 and 1. Also, $P_0$ represents a probability that a speech signal is absent from a t-th frame and is a value calculated by the modeling module 240.

The subtracted-spectrum-generation module 230 updates a noise spectrum using Y and $P_0$ received from the modeling module 240 S340. $N_e(t)$, which is the updated noise spectrum according to the Equation 1, is used as a noise spectrum to be subtracted from a next frame.

Results of subtracting a noise spectrum as described above are shown in FIGS. 4A and 4B.

Figure 4A:
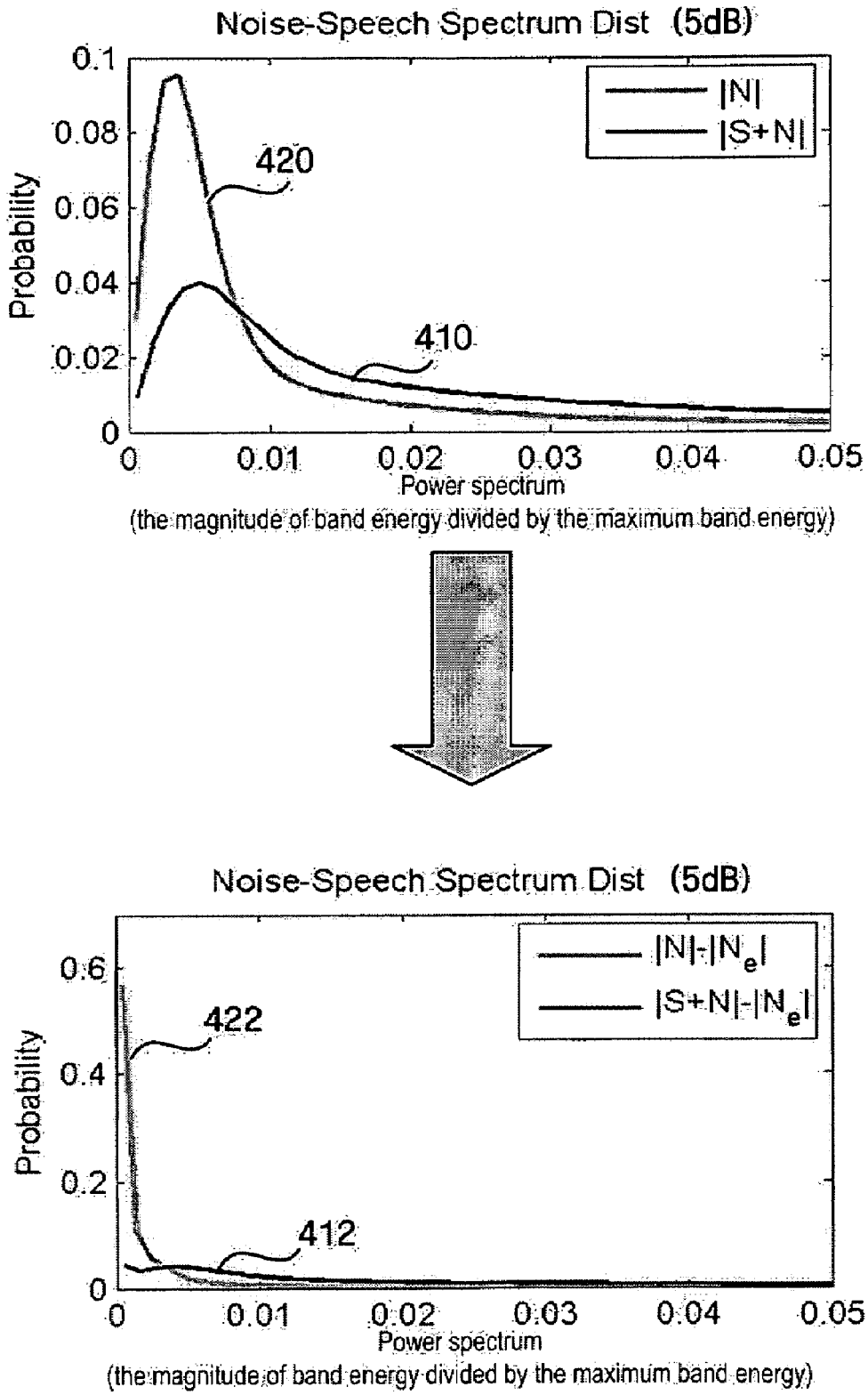
FIGS. 4A and 4B are histograms illustrating a subtraction effect of a noise spectrum according to an embodiment of the present invention.
Figure 4B:
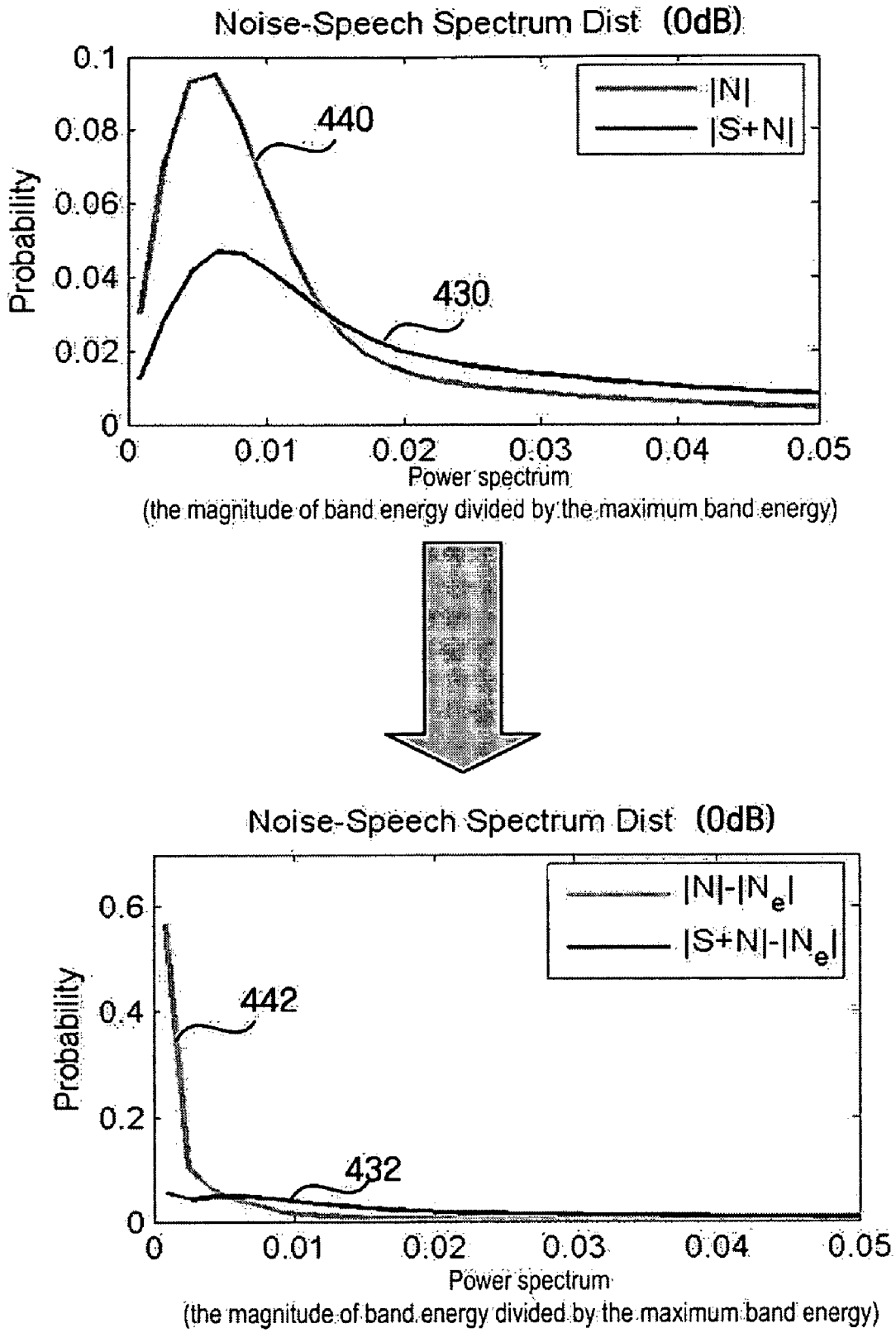

FIGS. 4A and 4B are histograms illustrating a subtraction effect of a noise spectrum according to an embodiment of the present invention. Referring to FIGS. 4A and 4B, the x-axis indicates the magnitude of band energy in a frequency band between 1 kHz and 1.03 kHz, and the y-axis indicates a probability with respect thereto.

In FIG. 4A, an SNR of an input signal is 5 dB. When a speech signal 410 having noise and a noise signal 420 are subtracted by the updated noise spectrum $N_e$, an intersection point of a subtracted speech signal 412 and noise signal 422 is inclined towards a point where a band energy level (x-axis) is 0. Accordingly, to distinguish the speech signal 412 and the noise signal 422 from the input signal is easier than before subtracting the noise spectrum $N_e$.

In FIG. 4B, an SNR of an input signal is 0 dB. Even in this case, when a speech signal 430 containing noise and a noise signal 440 are subtracted by the updated noise spectrum $N_e$, an intersection point of a subtracted speech signal 412 and a noise signal 422 is inclined towards a point where a band energy level (x-axis) is 0. Accordingly, distinguishing the speech signal 412 and the noise signal 422 from the input signal is easier than before subtracting the noise spectrum $N_e$.

Specifically, even when an SNR of an input signal is 0 dB, an overlapping area is decreased in a distribution of a speech signal and a noise signal. Also, the speech signal and the noise signal can easily be distinguished from the input signal.

The modeling module 240 receives a spectrum U subtracted from the subtracted-spectrum-generation module 230 and calculates a speech presence probability in U S360.

In the present embodiment, a statistical modeling method is used to calculate a speech presence probability.

As shown in FIGS. 4A and 4B, as a result of subtracting a noise spectrum from an input signal, there is a tendency that an intersection point of a speech signal and a noise signal is inclined towards a point where a band energy level (X-axis) is 0. Accordingly, a probability error may be reduced by applying a statistical model whose peak is close to 0 of a band energy level and whose histogram has a long tail.

As such a statistical model, the present embodiment utilizes a Rayleigh-Laplace distribution model.

The Rayleigh-Laplace distribution model applies a Laplace distribution to a Rayleigh distribution model. The detailed process will be described.

First of all, the Rayleigh distribution is defined as a probability density function of a complex random variable z. At this time, the complex random variable z can be expressed as:

$$z=r(\cos\theta+j\sin\theta)=x+jy$$

$$x=r\cos\theta,\ y=r\sin\theta \quad (3)$$

In Equation 3, r represents the magnitude or envelope, and θ represents a phase.

When two random processes x and y depend on Gaussian distribution having the identical variance and 0 as average, probability density functions P(x) and P(y) with respect to x and y respectively may be given by Equation 4 below, wherein $\sigma^2$ indicates variance.

$$P(x)=\frac{1}{\sqrt{2\pi\sigma_{xy}^2}}\exp\left(-\frac{x^2}{2\sigma_{xy}^2}\right),\ P(y)=\frac{1}{\sqrt{2\pi\sigma_{xy}^2}}\exp\left(-\frac{y^2}{2\sigma_{xy}^2}\right)$$

In this case, when it is assumed that x and y are statistically independent, a probability density function P(x,y) taking x and y as variables can be expressed by Equation 5:

$$P(x,y)=P(x)P(y)=\frac{1}{2\pi\sigma_{xy}^2}\exp\left(-\frac{x^2+y^2}{2\sigma_{xy}^2}\right)$$

When differential areas dxdy are converted into dxdy=r dr dθ, a joint probability density function for r and θ can be expressed by Equation 6:

$$P(r,\theta)=r\cdot P(x,y)=\frac{r}{2\pi\sigma_{xy}^2}\exp\left(-\frac{r^2}{2\sigma_{xy}^2}\right)$$

Also, when integrating P(r,θ) with respect to θ, a probability density function P(r) of r can be expressed by Equation 7:

$$\begin{aligned}p(r)&=\int_0^{2\pi}P(r,\theta)d\theta\ \ for\ r\geq 0\\&=\int_0^{2\pi}\frac{r}{2\pi\sigma_{xy}^2}\exp\left(-\frac{r^2}{2\sigma_{xy}^2}\right)d\theta\\&=\frac{r}{\sigma_{xy}^2}\exp\left(-\frac{r^2}{2\sigma_{xy}^2}\right)\end{aligned}$$

In this case, since $\sigma_r^2$ with respect to r may be expressed by Equation 8:

$$\sigma_r^2=E[r^2]=E[x^2+y^2]=E[x^2]+E[y^2]=2\sigma_{xy}^2$$

P(r) can be expressed by Equation 9:

$$P(r)=\frac{2r}{\sigma_r^2}\exp\left(-\frac{r^2}{\sigma_r^2}\right)$$

In the same manner as the Rayleigh distribution, the Rayleigh-Laplace distribution according to the present embodiment is defined as a probability density function of a complex random variable z like Equation 3.

However, contrary to the Rayleigh distribution, in the case of the Rayleigh-Laplace distribution, when two random processes x and y do not depend on Gaussian distribution having the identical variance and 0 as average, but depend on Laplacian distribution known in the art, probability density func tions P(x) and P(y) with respect to x and y can be expressed by Equation 10:

$$P(x) = \frac{1}{\sqrt{2\sigma_{xy}^2}}\exp\left(-\sqrt{2}\,\frac{|x|}{\sigma_{xy}}\right),\ P(y) = \frac{1}{\sqrt{2\sigma_{xy}^2}}\exp\left(-\sqrt{2}\,\frac{|y|}{\sigma_{xy}}\right)$$

When it is assumed that x and y are statistically independent, a probability density function P(x,y) taking x and y as variables can be expressed as Equation 11:

$$P(x, y) = P(x)P(y) = \frac{1}{2\sigma_{xy}^2}\exp\left(-\sqrt{2}\,\frac{|x|+|y|}{\sigma_{xy}}\right)$$

In this case, when differential areas dxdy are converted into dxdy=r dr dθ and it is supposed that |x|+|y|=r(|sin θ|+|cos θ|)≅r, a joint probability density function of r and θ can be expressed by Equation 12:

$$P(r, \theta) = r \cdot P(x, y) = \frac{r}{2\sigma_{xy}^2}\exp\left(-\sqrt{2}\,\frac{r}{\sigma_{xy}}\right)$$

Also, when integrating P(r,θ) with respect to θ, a probability density function P(r) of r can be expressed as Equation 13:

$$\begin{aligned} P(r) &= \int_0^{2\pi} P(r, \theta)d\theta \text{ for } r \geq 0 \\ &= \int_0^{2\pi} \frac{r}{2\sigma_{xy}^2}\exp\left(-\sqrt{2}\,\frac{r}{\sigma_{xy}}\right)d\theta \\ &= \frac{\pi r}{\sigma_{xy}^2}\exp\left(-\sqrt{2}\,\frac{r}{\sigma_{xy}}\right) \end{aligned}$$

In this equation, since $\sigma_r^2$ of r can be expressed by Equation 14:

$$\sigma_r^2 = E\lfloor r^2 \rfloor = E\lfloor x^2+y^2 \rfloor = E\lfloor x^2 \rfloor + E\lfloor y^2 \rfloor = 2\sigma_{xy}^2$$

P(r) can be expressed by Equation 15:

$$P(r) = \frac{2\pi r}{\sigma_r^2}\exp\left(-\frac{2r}{\sigma_r}\right)$$

Accordingly, when a probability that a speech signal may be present in a current frame according to the embodiment of the present invention is $P(Y_k(t)|H_1)$, $P(Y_k(t)|H_1)$ can be modeled by Equation 16:

$$P(Y_k(t) \mid H_1) \cong P(U_k(t) \mid H_1) = \frac{2\pi|U_k(t)|}{\lambda_{s,k}(t)}\exp\left[-\frac{2|U_k(t)|}{\lambda_{s,k}(t)}\right]$$

In Equation 16, $\lambda_{s,k}(t)$ is a variance estimate in a k-th frequency bin of a t-th frame. Such a variance estimate may be updated for each frame.

Meanwhile, a probability that a speech signal is absent from a k-th frame may be obtained by utilizing the aforementioned Rayleigh distribution model. In this case, the Rayleigh distribution model has an equivalent characteristic to a statistical model such as a complex Gaussian distribution.

When the probability that a speech signal is absent from the k-th frame is $P(Y_k(t)|H_0)$, $P(Y_k(t)|H_0)$ can be modeled by Equation 17:

$$P(Y_k(t) \mid H_0) \cong P(U_k(t) \mid H_0) = \frac{2|U_k(t)|}{\lambda_{n,k}(t)}\exp\left[-\frac{|U_k(t)|^2}{\lambda_{n,k}(t)}\right]$$

In Equation 17, $\lambda_{n,k}(t)$ is a variance estimate in the k-th frequency bin of t-th frame. Such a variance estimate may be updated for each frame.

For convenience of description, P(Yk(t)|H1)=$P_1$ and P(Yk(t)|H0)=$P_0$.

Figure 5:
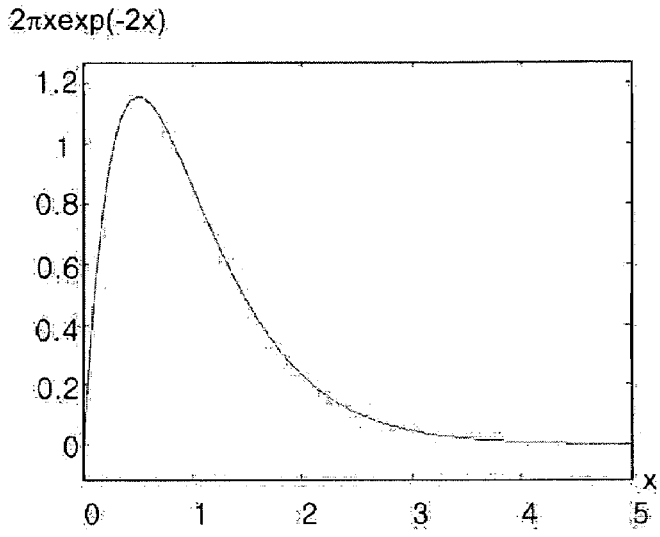
FIG. 5 is a graph illustrating Rayleigh-Laplace distribution according to an embodiment of the present invention.

FIG. 5 illustrates a probability distribution curve of the Rayleigh-Laplace distribution model. Referring to FIG. 5, a band energy level is more inclined towards 0 than that of the Rayleigh distribution model. It is apparent from a comparison of Equation 9 and Equation 15.

Meanwhile, the modeling module 240 transmits the speech absence probability $P_0$ in a current frame to the subtracted-spectrum-generation module 230 to update a noise spectrum.

Also, the modeling module 240 generates an index value which indicates whether a speech signal is present in the current frame, using $P_0$ and $P_1$.

For example, when an index value as to whether the speech signal is present in the current frame is A, A can be expressed by Equation 18:

$$A = \frac{P_1}{P_0 + P_1}$$

The speech-detection module 250 compares the index value generated by the modeling module 240 with a predetermined reference value and determines that a speech signal is present in the current frame when the index value is above the reference value S370.

Figure 6:
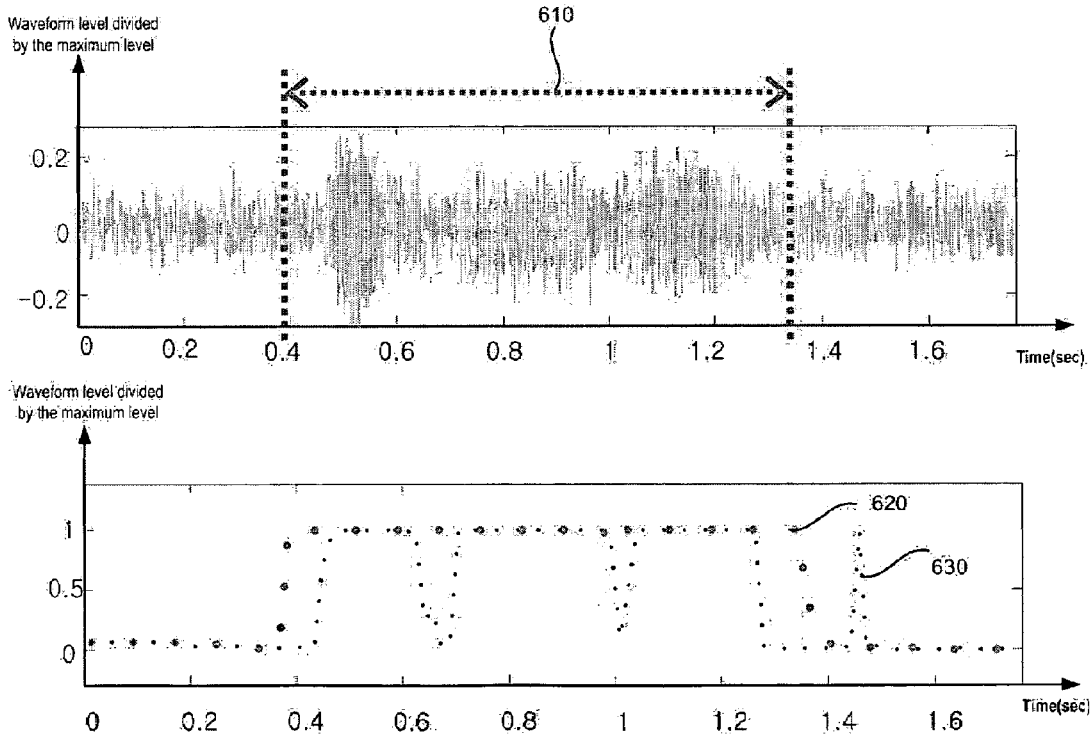
FIG. 6 is a graph illustrating the results of performance evaluation according to an embodiment of the present invention.

FIG. 6 is a graph illustrating the results of performance evaluation according to an embodiment of the present invention.

For experimental materials according to the embodiment, each of 8 males and 8 females uttered 100 words, e.g., persons' names, place names, firm names, etc. Specifically, 16 persons uttered 1600 words. Also, a vehicle noise was utilized as noise. In this instance, the utilized vehicle noise had been recorded in a vehicle which was driving on the highway at 100±10 km/h.

Also, for the experiments, the recorded noise was added to a speech signal having no noise (SNR=0 dB). A speech presence region was detected from the speech signal having the recorded noise and also compared with manually written end point information.

Meanwhile, the error of speech presence probability (hereinafter, referred to as "ESPP") and the error of voice activity detection (hereinafter, referred to as "EVAD") are used as measurement indexes.

The ESPP represents the difference between probability induced from a manually written voice activity and detected speech presence probability. The EVAD represents the difference between manually written voice activity and detected voice activity, as ms.

In a graph shown in FIG. 6, a reference number 610 represents a voice activity period which was written by a human being. Specifically, the human being manually indicates a start point and an end point of a speech signal after listening to a word uttered by another human being.

In comparison with the reference number 610, a reference number 620 represents a voice activity period detected from the speech detection probability according to an embodiment of the present invention and a reference number 630 represents a speech presence probability.

As shown in FIG. 6, it can be seen that the manually written voice activity period is almost identical to the voice activity period according to the embodiment of the present embodiment.

Also, Table 1 shows performance of ESPP according to the present embodiment in comparison with the first prior art and the second prior art as described above. Referring to Table, Y is an input signal that indicates a speech signal having noise. Specifically, Y=S (speech)+N (noise). U is an estimate of a speech signal which is obtained by an appropriate noise prevention algorithm. Specifically, $U=Y-N_e$, wherein $N_e$ represents a noise estimate.

TABLE 1

Estimates of the Speech Signal for ESPP Models

| ESPP Model | Y | U |
|---|---|---|
| First Conventional Art | 0.47 | 0.47 |
| Second Conventional Art | 0.35 | 0.34 |
| Embodiment of Present Invention | 0.35 | 0.28 |

Also, Table 2 and Table 3 show performance of EVAD according to the present invention in comparison with the first prior art and the second prior art.

TABLE 2

Estimates of the Start of Speech Signal for EVAD Models

| EVAD Model | Y (ms) | U (ms) |
|---|---|---|
| First Conventional Art | 134 | 134 |
| Second Conventional Art | 170 | 150 |
| Embodiment of Present Invention | 144 | 103 |

TABLE 3

Estimates of End Point of Speech Signal for EVAD Models

| EVAD Model | Y (ms) | U (ms) |
|---|---|---|
| First Conventional Art | 291 | 291 |
| Second Conventional Art | 214 | 193 |
| Embodiment of Present Invention | 196 | 131 |

As shown in Tables 1 to 3, it can be seen that at least one embodiment of the present invention is highly effective in voice detection in comparison with the conventional art described above.

According to the above-described embodiments of the present invention, it is possible to provide more improved performance in detecting speech of an input signal Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

What is claimed is:

1. An apparatus for detecting a voice activity period, comprising:

a processor which controls the operations of, a domain conversion module converting an input signal into a frequency domain signalin a unit of a frame of the input signal;

a subtracted-spectrum-generation module generating a spectral subtraction signal by subtracting a noise spectrum from the converted frequency domain signal;

a modeling module applying the spectral subtraction signal to a probability distribution model to yield a calculated probability distribution; and a speech-detection module determining whether a speech signal is present in a current frame based on the calculated probability distributions, wherein the probability distribution model applies a Laplacian distribution to a Rayleigh distribution model.

2. The apparatus of claim 1, wherein the domain conversion module converts the received input signal into the frequency domain signal using a Fast Fourier Transform (FFT).

3. The apparatus of claim 1, wherein the noise spectrum is calculated using the converted frequency domain signal and speech absence probability information from the modeling module.

4. The apparatus of claim 1, wherein the noise spectrum includes a noise spectrum with respect to a previous frame.

5. The apparatus of claim 1, where the probability distribution model includes a statistical model with a peak close to 0 of a band energy level and with a histogram with a long tail.

6. The apparatus of claim 1, wherein the speech-detection module determines whether speech is present in the current frame from a probability distribution of the probability distribution model.

7. The apparatus of claim 1, wherein the modeling module calculates a speech absence probability with respect to the current frame from the probability distribution model and transmits the calculated speech absence probability information to the subtracted-spectrum-generation module, and the subtracted-spectrum-generation module updates the noise spectrum using the transmitted speech absence probability information.

8. The apparatus of claim 1, wherein the frame of the input signal is obtained by dividing the input signal at predetermined intervals, one frame corresponding to one signal period, and the converting of an (n+1)-th frame is performed after a speech detection operation of an n-th frame is completed.

9. A method of detecting a voice activity period, comprising:

converting an input signal into a frequency domain signal in a unit of a frame of the input signal;

generating a spectral subtraction signal by subtracting a noise spectrum from the converted frequency domain signal;

applying the spectral subtraction signal to a probability distribution model to yield a calculated probability distribution; and determining whether a speech signal is present in a current frame based on the calculated probability distribution, wherein the probability distribution model applies a Laplacian distribution to a Rayleigh distribution model.

10. The method of claim 9, wherein the converting includes converting the received input signal into the frequency domain signal using a Fast Fourier Transform (FFT).

11. The method of claim 9, wherein the noise spectrum is calculated using the converted frequency signal and speech absence probability information according to application of the probability distribution model.

12. The method of claim 9, wherein the noise spectrum includes a noise spectrum with respect to a previous frame.

13. The method of claim 9, wherein the probability distribution model includes a statistical model with a peak close to 0 of a band energy level and with a histogram with a long tail.

14. The method of claim 9, wherein the determining determines whether speech is present in the current frame from a probability distribution of the probability distribution model.

15. The method of claim 9, wherein applying includes calculating a speech absence probability with respect to the current frame from the probability distribution model, and transmitting the calculated speech absence probability information, and the generating includes updating the noise spectrum using the transmitted speech absence probability information.

16. A computer-readable storage medium encoded with processing instructions for causing a processor to execute a method of detecting a voice activity period, comprising:

converting an input signal into a frequency domain signal in a unit of a frame of the input signal;

generating a spectral subtraction signal by subtracting a noise spectrum from the converted frequency domain signal;

applying the spectral subtraction signal to a probability distribution model to yield a calculated probability distribution; and determining whether a speech signal is present in a current frame based on the calculated probability distribution, wherein the probability distribution model applies a Laplacian distribution to a Rayleigh distribution model.

* * * * *

UNITED STATES PATENT AND TRADEMARK OFFICE

CERTIFICATE OF CORRECTION

PATENT NO. : 7,711,558 B2
APPLICATION NO. : 11/472304
DATED : May 4, 2010
INVENTOR(S) : Gil-jin Jang et al.

It is certified that error appears in the above-identified patent and that said Letters Patent is hereby corrected as shown below:

Column 10, Line 10, change "signalin" to --signaling--.

Column 10, Line 20, change "distributions," to --distribution,--.

Signed and Sealed this

Seventeenth Day of August, 2010

David J. Kappos

David J. Kappos
*Director of the United States Patent and Trademark Office*